US007942137B2

(12) United States Patent
Geskes et al.

(10) Patent No.: US 7,942,137 B2
(45) Date of Patent: May 17, 2011

(54) HEAT EXCHANGER

(75) Inventors: Peter Geskes, Ostfildern (DE); Ulrich Maucher, Korntal-Münchingen (DE); Michael Schmidt, Bietigheim-Bissingen (DE)

(73) Assignee: BEHR GmbH & Co., KG, Stuttgart (DE)

( * ) Notice: Subject to any disclaimer, the term of this patent is extended or adjusted under 35 U.S.C. 154(b) by 668 days.

(21) Appl. No.: 11/993,232

(22) PCT Filed: Jun. 23, 2006

(86) PCT No.: PCT/EP2006/006071

§ 371 (c)(1),
(2), (4) Date: Feb. 22, 2008

(87) PCT Pub. No.: WO2006/136437

PCT Pub. Date: Dec. 28, 2006

(65) Prior Publication Data

US 2010/0139631 A1 Jun. 10, 2010

(51) Int. Cl.
*F02M 25/07* (2006.01)
*F02B 47/08* (2006.01)
*F28F 13/12* (2006.01)

(52) U.S. Cl. ..... 123/568.12; 165/109.1; 165/174; 60/320

(58) Field of Classification Search ..... 123/41.31, 123/41.49, 568.12; 165/109.1, 152, 153, 165/172, 174, 179; 60/320, 321
See application file for complete search history.

(56) References Cited

U.S. PATENT DOCUMENTS

| | | | | |
|---|---|---|---|---|
| 3,154,141 | A | 10/1964 | Heut | |
| 4,314,587 | A | 2/1982 | Hackett | |
| 4,353,350 | A * | 10/1982 | Albrecht | 165/109.1 |
| 4,945,981 | A | 8/1990 | Joshi | |
| 5,655,599 | A | 8/1997 | Kasprzyk | |
| 5,762,887 | A | 6/1998 | Girod et al. | |
| 5,901,641 | A | 5/1999 | McNamara | |
| 6,070,616 | A | 6/2000 | Beck et al. | |
| 6,321,835 | B1 | 11/2001 | Damsohn et al. | |
| 6,484,795 | B1 | 11/2002 | Kasprzyk | |
| 6,892,806 | B2 | 5/2005 | Pantow et al. | |
| 6,944,947 | B1 | 9/2005 | Damsohn et al. | |

FOREIGN PATENT DOCUMENTS

| | | |
|---|---|---|
| CH | 363044 | 7/1962 |
| CH | 375031 | 2/1964 |
| DE | 1 931 148 | 1/1971 |
| DE | 195 11 665 A1 | 10/1996 |
| DE | 195 40 683 A1 | 5/1997 |
| DE | 195 54 368 A1 | 6/1998 |
| DE | 196 54 363 A1 | 6/1998 |
| DE | 196 54 366 A1 | 6/1998 |
| DE | 196 54 367 A1 | 6/1998 |
| DE | 101 27 084 A1 | 3/2002 |

(Continued)

*Primary Examiner* — Willis R Wolfe, Jr.
(74) *Attorney, Agent, or Firm* — Foley & Lardner LLP

(57) ABSTRACT

The invention relates to a heat exchanger with at least one duct, which can be flowed through by flowing medium from an inlet cross-section to an outlet cross-section, has an inside and outside, and which comprises, on the inside, structural elements for increasing the transfer of heat. The invention provides that the structural elements (11) are variably arranged and/or configured in the direction of flow (P) so that the duct (10), on the inside, has a variable heat transfer that, in particular, increases in the direction of flow (P).

24 Claims, 3 Drawing Sheets

FOREIGN PATENT DOCUMENTS

Figure 1:
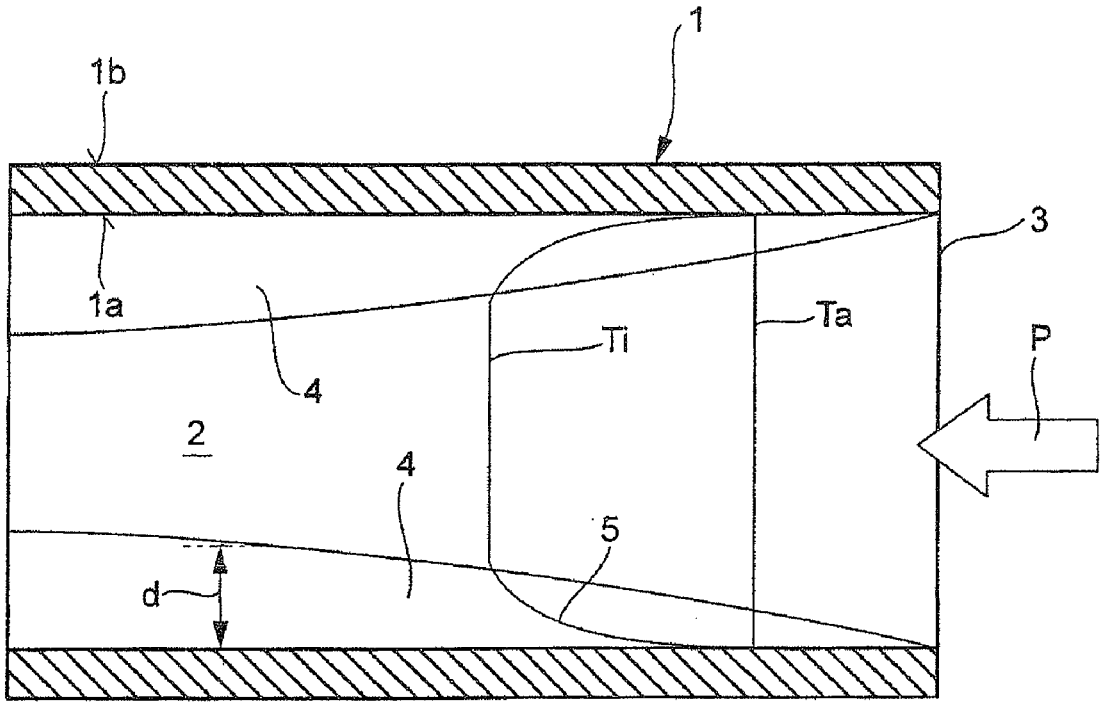

| | | | | |
|---|---|---|---|---|
| EP | 0 677 715 | A1 | | 10/1995 |
| EP | 0 767 000 | A1 | | 4/1997 |
| EP | 1 061 319 | A1 | | 12/2000 |
| EP | 1061319 | A1 | * | 12/2000 |
| FR | 1095966 | | | 6/1955 |
| JP | 60-185094 | A | | 9/1985 |
| WO | WO-97/37187 | A1 | | 10/1997 |

* cited by examiner

HEAT EXCHANGER

The invention relates to a heat exchanger—known from EP 0 677 715 A1 by the applicant.

It is known to arrange structural elements in flow ducts of heat exchangers in order to increase the heat transfer, which structural elements generate eddy and a turbulent flow. Such structural elements are known in a very wide variety of embodiments, for example as corrugated internal ribs, turbulence inlays, web ribs or else as eddy generators which are formed from the wall of the flow duct and which project into the flow. EP 0 677 715 A1 by the applicant has disclosed a heat exchanger with turbulence inlays which have clips which are set up in pairs and which form an angle with respect to the direction of flow. The known heat exchanger is used, in particular, to cool exhaust gas, in which case a means of cooling fluid or cooling air is provided. The clips which are arranged in V shape with V opening in the direction of flow generate, on the one hand, a turbulent flow, and through their formation of eddys they prevent a deposition of soot which is contained in the exhaust gas.

Developments of the structural elements which are arranged in a V shape have been disclosed for exhaust gas heat exchangers by DE 195 40 683 A1, DE 196 54 367 A1 and DE 196 54 368 A1 by the applicant. In this context, the structural elements which are arranged in a V shape are formed from the wall of the exhaust gas pipes by non-material-removing deformation. The structural elements which are arranged in V shape, also referred to as winglets can therefore be introduced into the exhaust gas pipes economically, i.e. at low cost.

As has been disclosed by EP 1 061 319 A1 and DE 101 27 084 A1 by the applicant, similar structural elements are also used for other types of heat exchangers, for example air-cooled coolant radiators. All the known structural elements have in common the fact that they are distributed essentially uniformly over the entire length of the respective flow ducts, whether they be exhaust gas pipes or coolant flat pipes. On the one hand, the desired increased heat transfer is achieved by means of the structural elements and, on the other hand, this advantage is obtained at the expense of an increased drop in pressure on the exhaust gas side or coolant side. In particular in the case of exhaust gas heat exchangers which are arranged in the exhaust gas recirculation line of an internal combustion engine, an increased pressure drop is not desired owing to the associated increased exhaust gas back pressure. On the other hand, increased power density is required in particular for exhaust gas heat exchangers of motor vehicles.

The object of the present invention is to improve a heat exchanger of the type mentioned at the beginning to the effect that an optimum between power density and pressure drop is achieved.

This object is achieved by means of the features of the claims. The invention provides that the density of the structural elements is variable, in particular increasing in the direction of the flow. With this structural measure the heat transfer coefficient on the inside of the flow duct also becomes variable, in particular the heat transfer increases in the direction of flow while it is comparatively low or minimal in the inlet region of the flow. The invention is based on the recognition that the discharge of heat in the inlet region of the flow duct, for example to a cooling medium which flows around the flow duct, is higher, owing to the high temperature difference prevailing there, than in the downstream region of the flow duct, and that a temperature boundary layer—which is formed on the inner wall of the flow duct and increases in the direction of flow—is still relatively thin.

To this extent in the inlet region it is possible to dispense with structural elements for increasing the heat transfer on the inside of the flow duct in favor of a pressure drop which is reduced in this region. The density of the structural elements is adapted here to the conditions with respect to temperature difference and a temperature boundary layer prevailing locally in the flow duct. The inventive arrangement of the structural elements provides the advantage that the pressure drop in the flow duct when there is a high power density is reduced.

Advantageous refinements of the invention emerge from the sub-claims. The inlet region of the flow duct can preferably firstly be made smooth-walled, i.e. formed without structural elements, since, as mentioned, a high power density is already achieved in this region owing to the large temperature difference and the small thickness of the boundary layer. When the temperature difference drops and the thickness of the boundary layer increases, structural elements with increasing density or with an effect which progressively increases the transmission of heat are then arranged downstream in the flow duct. The structural elements are advantageously embodied as eddy-generating impressions in the wall of the flow duct, referred to as winglets, such as are known for exhaust gas heat exchangers according to the prior art mentioned at the beginning. The arrangement and embodiment of the winglets in the flow duct can be made variable according to the invention and the spacing between the winglets in the direction of flow can thus increase continuously or in stages, as can the height of the winglets which extends into the flow. For reasons of fabrication it is advantageous if the spacing is in each case a multiple of the smallest spacing. In addition the angle which the winglets which are arranged in V shape enclose is increased continuously or in stages in the direction of flow, as a result of which the heat transfer, but also the drop in pressure, also increase.

According to a further advantageous embodiment of the invention, the inventive arrangement of the structural elements with variable density can advantageously be used in particular for exhaust gas heat exchangers of internal combustion engines for motor vehicles. Exhaust gas heat exchangers require, on the one hand, a high power density and, on the other hand, a low exhaust gas back pressure so that the required exhaust gas recirculation rates (proportion of the recirculated exhaust gas in the entire stream of exhaust gas) to comply with the emission rules can be achieved. The reduced drop in pressure which results from the invention can therefore have a particularly advantageous effect when the invention is used as an exhaust gas heat exchanger. Furthermore, an advantageous application in charge air coolers for internal combustion engines and generally in gas flow ducts is also provided.

In a further advantageous refinement of the invention, ribs, in particular web ribs, are arranged on the inside of the flow duct, as structural elements which increase the heat transfer. According to the invention the rib elements have a density which is variable in the flow direction, i.e. preferably increases in stages in the flow direction, wherein, in turn, it is possible to dispense entirely with internal ribbing in the inlet region. The change in the density can be achieved advantageously in the case of a web rib by means of a variable longitudinal pitch or transverse pitch or by means of a variable angle of incidence for the flow. This also provides the advantage of a reduced drop in pressure. In addition to changing the rib density, further measures could be taken to increase the heat transfer, for example the arrangement of seeds or windows in the edges of the corrugated ribs, also with the objective of making the heat transfer in the direction of flow variable. The measures according to the invention are advantageous in particular in the inlet region of the respective flow ducts i.e. in the region of the flow where non-steady-state ratios still prevail with respect to the temperature difference and the thickness of the boundary layer. These parameters reach virtually a steady state downstream, where a variable density of the structural elements no longer entails any significant advantages.

Figure 2:
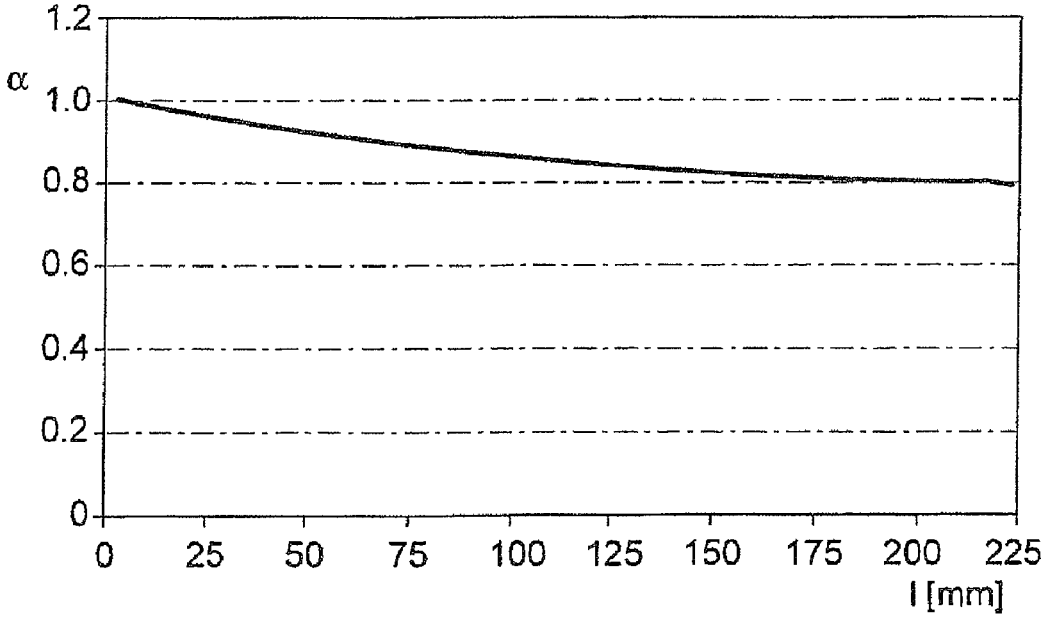
Figure 3A:
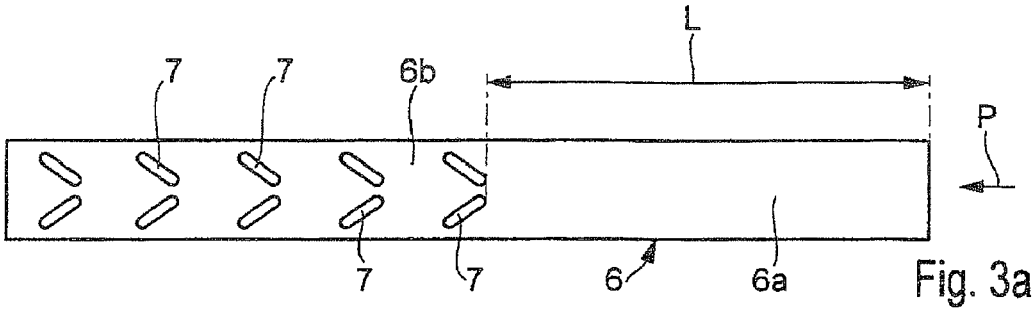
Figure 3B:
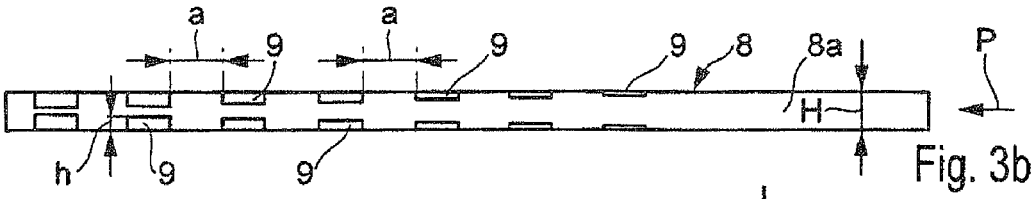
Figure 3C:
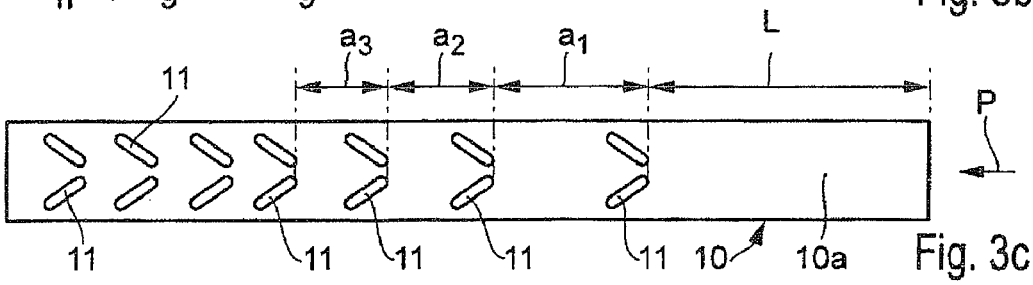
Figure 3D:
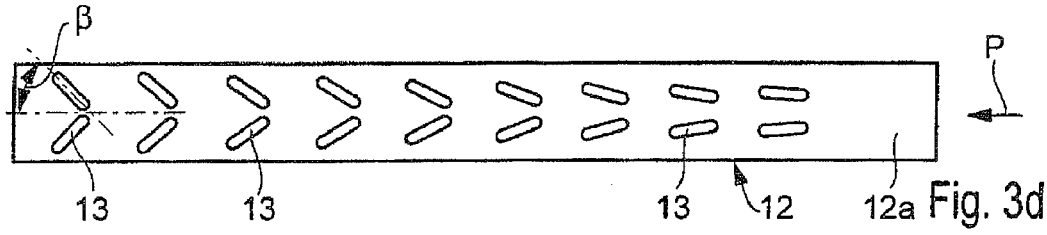
Figure 3E:
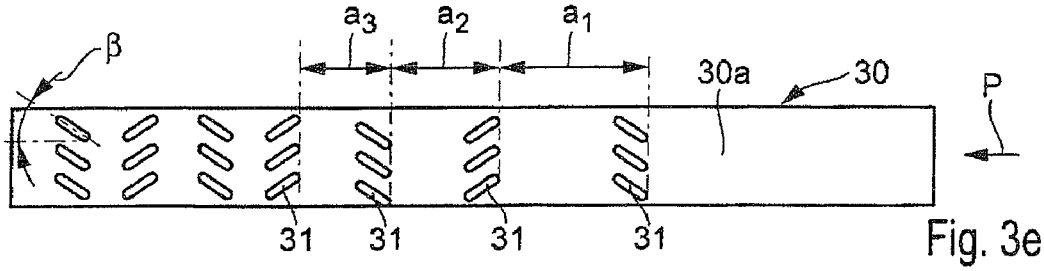
Figure 4:
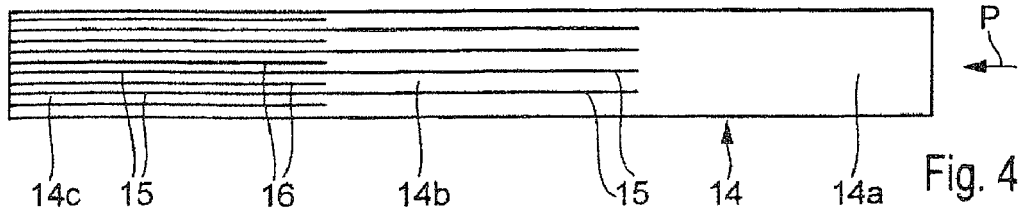
Figure 5:
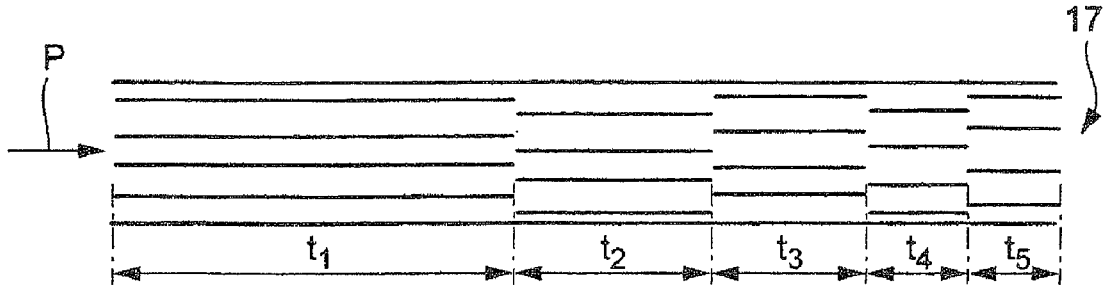
Figure 6:
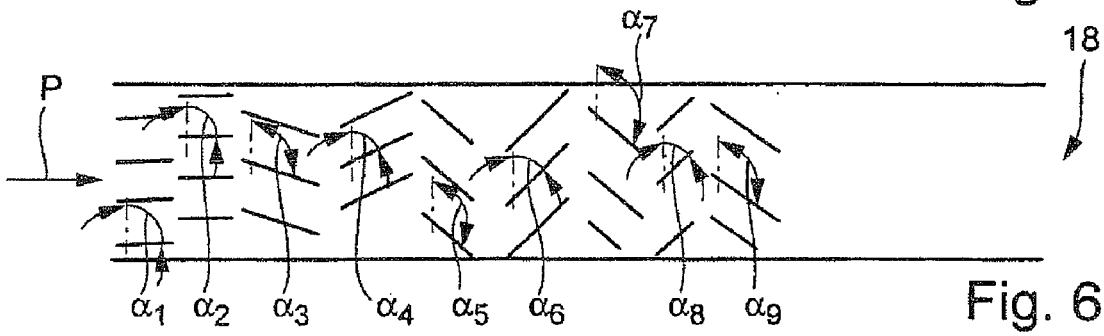
Figure 7:
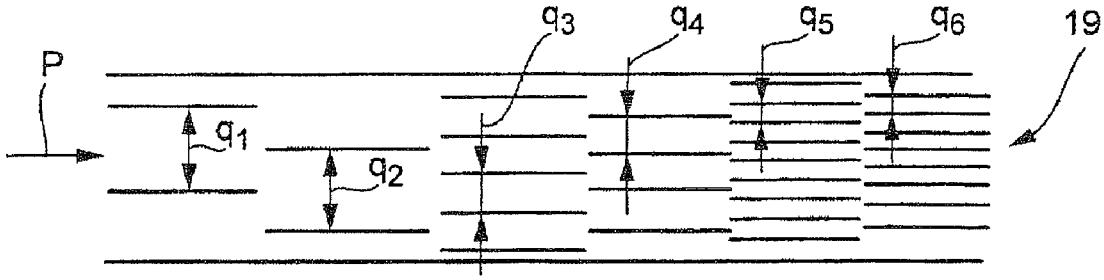
Figure 8:
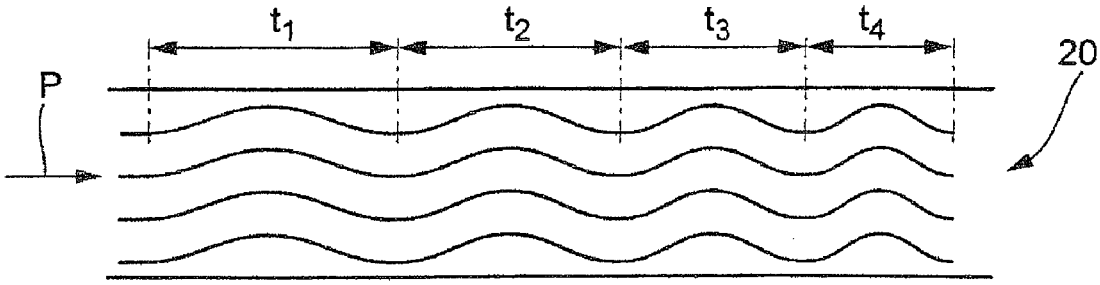

Exemplary embodiments of the invention are illustrated in the drawing and will be explained in more detail in the text which follows. In the drawing:

FIG. 1 shows a temperature profile in the inlet region of a flow duct,

FIG. 2 shows the dependence of the heat transfer coefficient α on the length of the flow duct, FIGS. 3*a*-3*e* show the inventive arrangement of structural elements with a variable density in a flow duct, FIG. 4 shows a second exemplary embodiment of the invention with internal ribs with differing rib densities, FIG. 5 shows a third exemplary embodiment of the invention for a web rib with variable longitudinal pitch, FIG. 6 shows a fourth exemplary embodiment of the invention for a web rib with a variable angle of incidence, FIG. 7 shows a fifth exemplary embodiment of the invention for a web rib with a variable transverse pitch, and FIG. 8 shows a sixth exemplary embodiment of the invention for a corrugated internal rib with a variable wavelength (pitch).

FIG. 1 shows a flow duct 2 which is embodied as a pipe 1 and which has an inlet cross section 3 and is flowed through by a flow medium in accordance with arrow P. The pipe 1 is preferably flowed through by a hot exhaust gas of an internal combustion engine (not illustrated) and is part of an exhaust gas heat exchanger (not illustrated). The pipe 1 has a smooth inside or inner wall 1*a* and an outside or outer wall 1*b*, which are cooled by a preferably liquid coolant. The hot exhaust gas therefore outputs its heat to the coolant via the pipe 1. When there is a flow through the flow duct 2, a temperature boundary layer 4 is formed on the inner wall 1*a*, which temperature boundary layer 4 increases in its density d from the inlet cross section 3 in the direction of flow of the arrow P. The temperature profile in this boundary layer 4 is illustrated by a temperature profile 5. The temperature in the temperature boundary layer therefore increases from a temperature Ta on the inner wall 1*a* up to a temperature level Ti in the interior of the flow duct (core flow) which corresponds to the exhaust gas inlet temperature. The growing temperature boundary layer 4 adversely affects the heat transfer conditions in the inlet region of the pipe 1.

FIG. 2 shows a diagram in which the heat transfer coefficient α is plotted as a relative variable over the length 1 of a smooth-walled flow duct, i.e. of the inlet cross section (reference number 3 in FIG. 1) in the direction of flow of the flow medium. The length l is plotted in millimeters. The heat transfer coefficient α is set to 1 (100%) in the inlet cross section, i.e. when l=0. As the length increases, i.e. in the direction of flow in the flow duct 2 (FIG. 1), the heat transfer coefficient α drops to approximately 0.8 (80%) of the value at the inlet cross section. This is primarily due to the formation of the temperature boundary layer 4 according to FIG. 1.

FIGS. 3*a*, 3*b*, 3*c*, 3*d* and 3*e* show a first exemplary embodiment of the invention with five different variants, specifically the arrangement of structural elements with a variable density. FIG. 3*a* shows, in a first variant, a schematically illustrated flow duct 6, preferably an exhaust pipe of an exhaust gas heat exchanger (not illustrated), wherein the exhaust pipe 6 is flowed through in accordance with the arrow P. There is preferably fluid coolant but possibly also air, flowing around the outside of the exhaust pipe 6, which is not illustrated but is known from the prior art mentioned at the beginning. The exhaust pipe 6 is embodied as a stainless steel pipe, composed of two halves which are welded to one another and which have a rectangular cross section. The exhaust pipe 6 has an inlet region 6*a* which is of a smooth-walled design over a length L. The smooth-walled region 6*a* is adjoined downstream by a region 6*b* in which structural elements 7, referred to as winglets, which are arranged in V shape and are stamped out of the tubular wall, are arranged. The winglet pairs 7 are arranged in the section 6*b* with the same spacing and in the same design. The junction between the smooth-walled region 6*a* and the region 6*b* which is provided with winglets 7 is therefore in the form of a "step". As mentioned at the beginning, in the smooth-walled region 6*a* a sufficiently high level of heat transfer or heat transmission is achieved despite the lack of structural elements since the temperature difference is still sufficiently large and the temperature boundary layer is relatively small. At the point where these conditions no longer apply, structural elements 7 which ensure that the heat transfer (heat transfer coefficient α) is improved are arranged. The smooth-walled region 6*a*—this also applies to the following variants 3*b*, 3*c*, 3*d*, 3*e*—can have a length of up to 100 mm.

In a second variant according to FIG. 3*b* a rectangular pipe 8 is illustrated in a longitudinal section, and this also has a smooth-walled inlet region 8*a* and a duct height H. Arranged downstream of this smooth-walled region 8*a* are winglet pairs 9 with spacings a which are the same in the direction of flow but with different heights h—the heights h of the winglet pairs 9 which project into the flow cross section of the exhaust pipe 8 increase continuously in the direction of flow P. The heat transfer in this tubular section is therefore successively increased. At the same time, the pressure drop increases. The junction between the smooth region and the non-smooth region is thus continuous. In one preferred embodiment, a range of $0.05 \leqq h/H \leqq 0.4$ is selected for the ratio h/H.

In a third variant according to FIG. 3*c*, winglet pairs 11 with spacings $a_1$, $a_2$, $a_3$ which decrease in the direction of flow P are arranged in a pipe 10. The heat transfer is therefore successively increased starting from the smooth inlet region 10*a* since the density of the structural elements or winglets 11 becomes greater. For reasons of simplified fabrication, the spacings $a_1$, $a_2$, $a_3$ can each be a multiple of the minimum spacing $a_x$. The latter is advantageously in a range of $5<a_x<50$ mm and preferably in a range of $8<a_x<30$ mm.

FIG. 3*d* shows a fourth variant of the arrangement of structural elements with different densities in an exhaust pipe 12 through which exhaust gas can flow in accordance with the arrow P. The smooth-walled inlet region 12*a* is comparatively shorter in relation to the previous exemplary embodiments. It is adjoined by winglet pairs 13 with spacings which are the same in the direction of flow, but with a different angle β (angle with respect to the direction of flow P). The winglets of the winglet pair 12 which are located upstream are almost oriented in parallel (β≈0), while the angle β, formed by the winglets, of the winglet pair 13 which are located downstream is approximately 45 degrees. The winglet pairs 13 which are located between them have corresponding intermediate values so that the heat transfer coefficient for the inner wall of the exhaust pipe 13 increases owing to the increasing splaying of the winglets in the direction of flow, specifically continuously or in small increments. The angle β is advantageously in a range of $20° < \beta < 50°$.

FIG. 3*e* shows a fifth variant with an exhaust pipe 30, a smooth-walled region 30*a* and adjoining rows of winglets 31 which are arranged in parallel with one another and which each form an angle β with the direction of flow P. The rows have decreasing spacings $a_1$, $a_2$, $a_3$ in the direction of flow P with angle β of the winglets 31 changing sign from row to row.

A smooth region without structural elements is left on all the pipes, preferably at the start and at the end of the pipe, so that a clean dividing point can be manufactured when the pipes are cut to length.

FIG. 4 shows a further exemplary embodiment of the invention for a flow duct 14 against which a flow medium flows in accordance with the arrow P—this may be a liquid coolant or else charge air. The outside of the flow duct 14 can be cooled by a gaseous or liquid coolant. The flow duct 14 has a smooth-walled inlet region 14*a* which is adjoined in the direction of flow P by a first region 14*b* which is provided with internal ribs 15 and it is adjoined by a further ribbed region 14*c*. The regions 14*b* and 14*c* have different rib densities—in the illustrated exemplary embodiment the rib density in the region 14*c* located downstream is twice as high as in the region 14*b* located upstream since further ribs 16 are arranged between the ribs 15 which pass through. This also brings about an increase in the heat transfer, specifically in stages from 14*a* via 14*b* to 14*c*.

FIG. 5 shows, as a third exemplary embodiment of the invention, a gas flow duct in which a web rib 17 with variable longitudinal pitch $t_1$, $t_2$, $t_3$, $t_4$, $t_5$ is arranged. In the illustration in the drawing, $t_1>t_2>t_3>t_4>t_5$, i.e. the heat transfer increases from $t_1$ to $t_5$, i.e. in the direction of flow P. Web ribs are used in particular in charge air coolers and preferably soldered to the pipes. In one advantageous embodiment, the ratio of the smallest pitch $t_x$ to the duct height H has a limiting value of $0.3<t_x/H$.

FIG. 6 shows, as a fourth exemplary embodiment of the invention, a gas flow duct in which a web rib 18 with variable angles of incidence $\alpha_1$, $\alpha_2$, $\alpha_3$ . . . $\alpha_x$ is arranged. Advantageous angles of incidence lie in the range of $0<\alpha<30°$.

FIG. 7 shows, as a fifth exemplary embodiment of the invention, a gas flow duct in which a web rib 19 with variable transverse pitch $q_1$, $q_2$, $q_3$ . . . $q_6$ is arranged, wherein the heat transfer rises as the transverse pitch decreases from $q_1$ in the direction of $q_6$, i.e. in the direction of flow P. Advantageous ranges for the transverse pitch q are $8>q>1$ mm and preferably $5>q>2$ mm.

FIG. 8 shows, in a gas flow duct, an internal rib 20 which is corrugated (depth corrugated) in the direction of flow P and has a variable pitch $t_1$, $t_2$, $t_3$ $t_4$—the heat transfer rises here in the direction of decreasing pitch t. Advantageous ranges for the pitch t are $10<t<50$ mm.

In a refinement of the illustrated exemplary embodiments, a variation of the heat transfer in the flow duct can also be achieved by means of further means which are known from the prior art, for example by arranging gills or windows in the ribs. Furthermore, other shapes of structural elements for generating eddys and/or for increasing the heat transfer can be selected. The application of the invention is not restricted to exhaust gas heat exchangers, but rather it also extends to charge air coolers whose pipes are flowed through by hot charge air, and generally to gas flow ducts which can be embodied as pipes of a pipe bundle heat exchanger or as disks of a disk heat exchanger.

The invention claimed is:

1. A heat exchanger comprising:

at least one flow duct configured to allow flow of a flow medium from an inlet cross section to an outlet cross section in a direction of flow; and a plurality of winglets arranged on an inside surface of the at least one flow duct comprising:

a first row of winglets;

a second row of winglets arranged downstream of the first row of winglets; and a third row of winglets arranged downstream of the second row of winglets, wherein each row of winglets comprises at least two winglets forming a v-shape, and wherein a distance between the first row of winglets and the second row of winglets is greater than the distance between the second row of winglets and the third row of winglets.

2. The heat exchanger of claim 1, wherein the distance between the second row of winglets and the third row of winglets is between 5 mm and 50 mm.

3. The heat exchanger of claim 1, further comprising at least one additional row of winglets.

4. The heat exchanger of claim 1, wherein the plurality of winglets is arranged such that a pressure drop in the flow duct increases in the direction of flow.

5. The heat exchanger of claim 1, wherein the at least one flow duct comprises two flow ducts, wherein the two flow ducts are exhaust pipes configured to allow an exhaust gas to flow therethrough, and configured to allow a coolant to flow around the exhaust pipes.

6. The heat exchanger of claim 1, wherein the heat exchanger is a charge air cooler configured to cool combustion air for an internal combustion engine of a motor vehicle.

7. The heat exchanger of claim 1, wherein the flow duct has, starting from the inlet cross section, a smooth-walled section without winglets.

8. The heat exchanger of claim 7, wherein the smooth-walled section has a length that is less than 100 mm.

9. A heat exchanger comprising:

at least one flow duct configured to allow flow of a flow medium from an inlet cross section to an outlet cross section in a direction of flow; and a plurality of winglets arranged on an inside surface of the at least one flow duct comprising:

a first row of winglets; and a second row of winglets arranged downstream of the first row of winglets, wherein each row of winglets comprises at least two winglets forming a v-shape, wherein the winglets of each row form an angle β with the direction of flow, and wherein an angle $\beta_1$ between the winglets of the first row and the direction of flow is smaller than an angle $\beta_2$ between the winglets of the second row and the direction of flow.

10. The heat exchanger of claim 9, wherein the angles β, $\beta_1$, and $\beta_2$ are between 20° and 50°.

11. The heat exchanger of claim 9, wherein the plurality of winglets is arranged such that a pressure drop in the flow duct increases in the direction of flow.

12. The heat exchanger of claim 9, wherein the at least one flow duct comprises two flow ducts, wherein the two flow ducts are exhaust pipes configured to allow an exhaust gas to flow therethrough, and configured to allow a coolant to flow around the exhaust pipes.

13. The heat exchanger of claim 9, wherein the heat exchanger is a charge air cooler configured to cool combustion air for an internal combustion engine of a motor vehicle.

14. The heat exchanger of claim 9, wherein the flow duct has, starting from the inlet cross section, a smooth-walled section without winglets.

15. The heat exchanger of claim 14, wherein the smooth-walled section has a length that is less than 100 mm.

16. A heat exchanger comprising:

at least one flow duct configured to allow flow of a flow medium from an inlet cross section to an outlet cross section in a direction of flow; and a plurality of ribs arranged on an inside surface of the at least one flow duct comprising:

a first row of ribs; and a second row of ribs arranged downstream of the first row of ribs, wherein the ribs are parallel with the direction of flow, and wherein a distance between adjacent ribs in the first row of ribs is greater than a distance between adjacent ribs in the second row of ribs.

17. The heat exchanger of claim 16, wherein the distance between adjacent ribs in the first row of ribs and the second row of ribs is between 1 mm and 8 mm.

18. The heat exchanger of claim 16, wherein at least one rib in the first row of ribs is integral with at least one rib in the second row of ribs.

19. The heat exchanger of claim 16, wherein the plurality of ribs is arranged such that a pressure drop, in the flow duct increases in the direction of flow.

20. The heat exchanger of claim 16, wherein the ribs are soldered to the flow duct.

21. The heat exchanger of claim 16, wherein the at least one flow duct comprises two flow ducts, wherein the two flow ducts are exhaust pipes configured to allow an exhaust gas to flow therethrough, and configured to allow a coolant to flow around the exhaust pipes.

22. The heat exchanger of claim 16, wherein the heat exchanger is a charge air cooler configured to cool combustion air for an internal combustion engine of a motor vehicle.

23. The heat exchanger of claim 16, wherein the flow duct has, starting from the inlet cross section, a smooth-walled section without ribs.

24. The heat exchanger of claim 23, wherein the smooth-walled section has a length that is less than 100 mm.

* * * * *